US005957282A

United States Patent [19]

Juszkiewicz et al.

[11] Patent Number: 5,957,282

[45] Date of Patent: Sep. 28, 1999

[54] PACKAGE FOR MUSICAL INSTRUMENT STRINGS

[75] Inventors: Henry E. Juszkiewicz, Nashville; Julia A. Tissue, Franklin, both of Tenn.

[73] Assignee: Gibson Guitar Corp., Nashville, Tenn.

[21] Appl. No.: 09/098,924

[22] Filed: Jun. 17, 1998

[51] Int. Cl.[6] ..... B65D 85/04

[52] U.S. Cl. ..... 206/314; 53/430; 206/388; 242/170

[58] Field of Search ..... 53/430; 206/14, 206/49, 314, 388, 389, 395, 409; 242/159, 160.1, 160.4, 170–172, 535.1, 566

[56] References Cited

U.S. PATENT DOCUMENTS

| | | | |
|---|---|---|---|
| 197,585 | 11/1877 | Ashman . | |
| 488,005 | 12/1892 | Griffith . | |
| 607,130 | 7/1898 | Rapp . | |
| 718,114 | 1/1903 | Finney . | |
| 2,579,131 | 12/1951 | Tinsley | 206/409 |
| 3,180,487 | 4/1965 | Uddenborg . | |
| 3,301,393 | 1/1967 | Regan . | |
| 3,352,416 | 11/1967 | Lo Duca . | |
| 3,490,192 | 1/1970 | Regan . | |
| 3,618,282 | 11/1971 | Hagel et al. | 206/314 |
| 3,759,376 | 9/1973 | Lisowski | 206/63.3 |
| 3,857,484 | 12/1974 | Thyen | 206/227 |
| 3,972,418 | 8/1976 | Schuler | 206/63.3 |
| 4,034,850 | 7/1977 | Mandel | 206/63.3 |
| 4,126,221 | 11/1978 | Cerwin | 206/63.3 |
| 4,391,365 | 7/1983 | Batchelor | 206/63.3 |
| 4,961,498 | 10/1990 | Kalinski | 206/339 |
| 4,974,789 | 12/1990 | Milburn | 242/159 |
| 5,109,983 | 5/1992 | Malone | 206/408 |
| 5,129,511 | 7/1992 | Brown | 206/63.3 |
| 5,263,585 | 11/1993 | Lawhon et al. | 206/388 |
| 5,392,903 | 2/1995 | Sinn | 206/63.3 |
| 5,560,477 | 10/1996 | Scanlon | 206/63.3 |
| 5,568,865 | 10/1996 | Mase et al. | 206/388 |
| 5,582,288 | 12/1996 | Zatarga | 206/63.3 |
| 5,704,473 | 1/1998 | Oster | 206/314 |

*Primary Examiner*—Jim Foster

*Attorney, Agent, or Firm*—Lucian Wayne Beavers Waddey & Patterson

[57] ABSTRACT

A method and package for housing and dispensing at least one musical instrument string. The package includes a housing adapted to contain the at least one string in a generally coiled configuration. The package further includes at least one opening from which an end of the at least one string protrudes. The at least one opening is configured to retain and end of the at least one string adjacent an exterior of the housing to facilitate extraction of the string from the package. Alternate embodiments of the package include a plurality of separate compartments in a stacked or concentric configuration, each compartment having an opening to enable extraction of a string contained therein.

24 Claims, 7 Drawing Sheets

PACKAGE FOR MUSICAL INSTRUMENT STRINGS

BACKGROUND OF THE INVENTION

The present invention relates generally to packaging for elongated, flexible strings for musical instruments, such as guitars, and more particularly to a package for housing and dispensing one or more such strings.

A guitar generally has six strings which are attached to the guitar body in tension such that when the strings are set in motion, as by picking or strumming, musical sound is produced. The strings are constructed of different metals and vary in thickness to produce different musical notes. The six strings E, A, D, G, B and E represent the standard tuning of the guitar, and all manufacturers build guitars in accordance with this standard.

Most guitar strings are packaged and sold in sets of six strings. In accordance with conventional packaging methods, each string is coiled by hand and inserted into a paper sleeve or envelope. The six sleeves or envelopes are then inserted into either a plastic pouch or a cardboard box. Thus, changing a string on a guitar involves the reverse two-step process. First, the consumer must open the pouch or box and remove the envelope or sleeve containing the desired string. Then, the string must be removed from the sleeve, uncoiled and installed on the guitar.

Each guitar string comprises an elongated, flexible body having a "ball end" and a plain end. The ball end includes a round metal connector attached at the end of the string for anchoring the string to the bridge of the guitar. The plain end of the string is threaded through a tuning machine, which is adjustable to increase or decrease the tension on the string. By adjusting each of the tuning machines, the strings may be tuned to the standard E, A, D, G, B, E tuning.

Being constructed of metal, guitar strings have a tendency to recoil to an elongated, relaxed position. Thus, when coiled and inserted in an envelope or sleeve, the string has a tendency to exert a force against the outer periphery of the container.

Accordingly, the art to which the present invention relates includes packaging for the strings of musical instruments, such as guitars or banjos, which are constructed of metal and, therefore, have a tendency to extend to an elongated position. It will be appreciated by those skilled in the art that it is desirable to have a package for housing and dispensing one or more such strings. To this end, there have been several attempts to devise containers for housing the strings in a coiled position.

One such attempt was disclosed in U.S. Pat. No. 197,585, issued to Ashman, which is incorporated by reference as if fully set forth herein. The Ashman disclosure is directed to a pocket box for violin strings comprising a circular box formed of two semicircular sections, which may or may not be hinged. A pair of spaced apart flanges project upwardly from the interior of the box and serve to guide the cover and to protect the strings, which are positioned therebetween. The coiled strings are inserted adjacent one another inside the box as shown in FIG. 1.

U.S. Pat. No. 488,005, issued to Griffith, which is incorporated by reference as if fully set forth herein, is directed to an impervious case for containing strings for musical instruments comprising a plurality of adjacent pockets configured to receive and contain a coiled string.

U.S. Pat. No. 607,130, issued to Rapp, which is incorporated by reference as if fully set forth herein, is directed to a string case comprising a pliable folding case having a plurality of individual pockets, each of which is configured to receive a coiled string.

U.S. Pat. No. 718,114, issued to Finney, which is incorporated by reference as if fully set forth herein, is directed to a receptacle for strings for musical instruments comprising a cylindrical container having a set of annular complementary removable receptacles each of which is adapted to contain a coil of string. Each receptacle forms an independent hollow ring having a complete annular chamber adapted to receive one or more coils of string. When the receptacles are nested together, the outer wall of one receptacle forms an inner wall for the adjacent receptacle.

One disadvantage of the Finney device is that a receptacle must be removed from the case in order to access the string contained therein. Furthermore, in order to access a single receptacle, an entire set of nested receptacles must first be removed from the case. Also, the string contained in the annular chamber may only be accessed from the inner open side of the receptacle. The device does not include any means for dispensing the string.

U.S. Pat. No. 3,352,416, issued to Lo Duca, which is incorporated by reference as if fully set forth herein, is directed to an instrument string package comprising a plurality of panels, one of which includes a plurality of arcuate slits formed therein for receiving a coiled string.

U.S. Pat. No. 4,974,789 issued to Milburn, which is incorporated by reference as if fully set forth herein, is directed to a dispensing package for a fiber-optic device comprising two mating members and a separator disposed therebetween. The two mating members have centrally located openings and are joined at their mating edges and define a cavity therebetween. The separator is secured between the mating members to divide the cavity into first and second cable receiving chambers for accommodating a circularly coiled cable portion.

U.S. Pat. No. 5,109,983 issued to Malone et al., which is incorporated by reference as if fully set forth herein, is directed to a package for an optical fiber jumper comprising a sheet having allochiral halves each with cut-outs to form ears upon which to spirally wind a length of optical fiber. The halves are folded together.

The list that follows includes patents directed to packaging for sutures, which do not include the recoil characteristics of metal strings.

| U.S. Pat. No. | Inventor |
|---|---|
| 3,301,393 | Regan, Jr., et al. |
| 3,490,192 | Regan, Jr. |
| 3,759,376 | Lisowski |
| 3,857,484 | Thyen |
| 3,972,418 | Schuler et al. |
| 4,034,850 | Mandel et al. |
| 4,126,221 | Cerwin |
| 4,391,365 | Batchelor |
| 4,961,498 | Kalinski et al. |
| 5,129,511 | Brown et al. |
| 5,392,903 | Sinn |
| 5,560,477 | Scanlon |
| 5,582,288 | Zatarga |

While these patents generally disclose the concept of housing one or more strings, none discloses a dispenser configured to enable the "ball end" of each string to protrude from an opening formed in the housing containing the string so that the string may be easily extracted.

What is needed, then, is a package for housing and dispensing strings for musical instruments, such as guitars and banjos, wherein an end of each of the strings protrudes from the package enabling the user to extract the string by merely grasping the protruding end to uncoil the string and remove it from the package. This device is presently lacking in the prior art.

SUMMARY OF THE INVENTION

The present invention is directed to a package for housing and dispensing at least one string for musical instruments. The package may be constructed of any suitable material, such as cardboard, plastic and the like. Further, the package may be configured to house and dispense a single instrument string or a plurality of strings.

The package comprises a housing configured to receive and contain at least one string. An opening is formed in the housing for enabling an end of the at least one string to protrude from the housing and to facilitate extraction of the at least one string. The housing includes spaced apart planar sides separated by a peripheral edge, and the opening is preferably formed along the edge of the housing. The opening may include a notch configured to retain the end of the string adjacent the exterior of the housing. The housing may be of any shape or configuration that is suitable for containing at least one string, including without limitation, square, rectangular, circular and oval.

In an alternate embodiment, the housing includes a plurality of compartments, each of which is configured to contain a string. The compartments may be concentric and positioned in a single plane. Alternatively, the compartments may be positioned in parallel planes in a stacked configuration.

In one embodiment of the present invention, the compartment comprises a retaining ring having a base, a top or rim, a cylindrical core and an outer wall defining an annular cavity adapted to receive and contain at least one string. An opening is provide in the retaining ring to facilitate the extraction of the string from the cavity. The opening is configured such that a connector or anchoring member attached to one end of the string protrudes therefrom enabling a user to grasp the connector and remove the string. This embodiment may include a plurality of concentric annular compartments such that the outer wall of each annular compartment forms an inner wall for the adjacent compartment. The package includes an opening into each of the plurality of compartments to enable removal of the string contained therein.

It is an object of the present invention to provide in combination at least one string for a musical instrument and a package for dispensing the at least one string comprising a housing having an opening from which an end of the at least one string protrudes to enable a user to easily grasp the string and extract the string from the housing.

It is an object of the present invention to provide a package for housing and dispensing strings for musical instruments comprising a retaining ring having a cavity and an opening formed in the retaining ring for extracting a string from the cavity.

It is an object of the present invention to provide a package for housing and dispensing at least one string for a musical instrument wherein an connector attached to one end of the at least one string protrudes from an opening in the package enabling a user to grasp the connector and extract the string from the package.

It is an object of the present invention to provide a package for at least one string for a musical instrument that enables a user to easily remove the at least one string therefrom.

It is an object of the present invention to provide a package for a set of strings for a musical instrument that eliminates the need for packaging each string individually and also packaging the set.

These and other objects, features and advantages shall become apparent after consideration of the description and drawings set forth herein. All such objects, features and advantages are contemplated to be within the scope of the present invention even though not specifically set forth herein.

DESCRIPTION OF THE PREFERRED EMBODIMENT

Figure 1A:
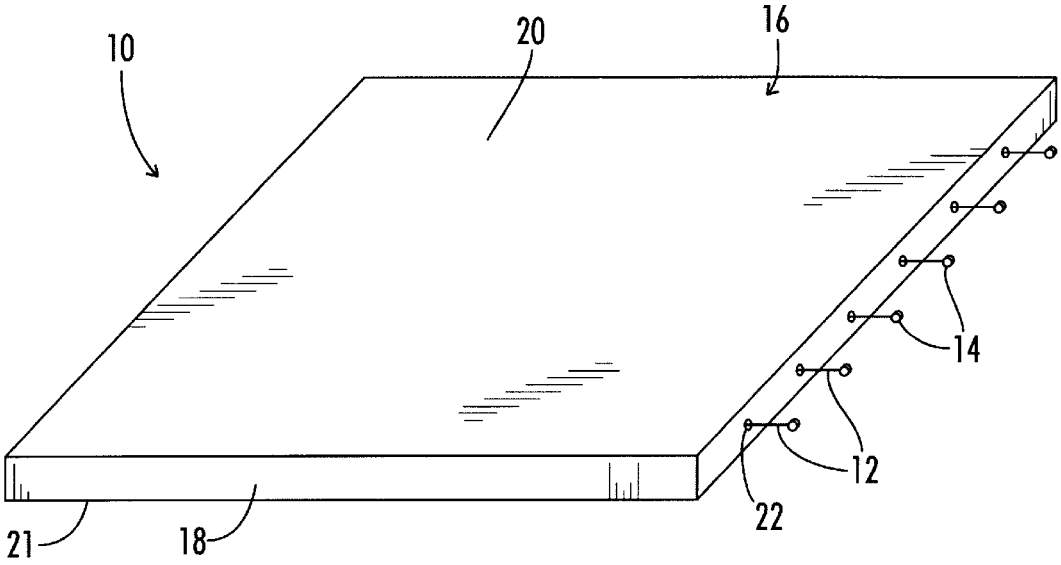
FIG. 1A is a perspective view of an embodiment of a single string package and dispenser of the present invention.

An embodiment of a string package of the present invention is designated generally by the reference numeral 10 in FIG. 1A. The package 10 is configured to contain at least one musical instrument string 12 in a coiled configuration. The typical guitar string 12 comprises an elongated metal strand having opposing ends. One end of the string 12, referred to as the "ball end", includes a connector member or anchor 14 for securing the string 12 to the bridge of a stringed instrument.

The package 10 comprises a housing 16 having a peripheral edge 18 disposed between spaced apart sides 20 and 21, which may also form a top and a bottom, respectively, of the package 10. The generally square configuration of the package 10 shown in FIG. 1 is intended to be illustrative only; thus, other shapes and configurations, including ovals, circles, rectangles and the like are contemplated to be within the scope of the present invention.

At least one opening or aperture 22 is formed in the housing 16 to facilitate the extraction of the at least one string 12 from the housing 16. The at least one opening 22 is preferably formed along the peripheral edge 18 of the housing 16. Alternatively, the at least one opening 22 may be formed on either the top 20 or the bottom 21 of the housing 16. The opening 22 is configured to enable the "ball end" of the string 12 to protrude from the housing 16 and to prevent the end of the string 12 from retracting into the housing 16. In this manner, the connector member 14 is positioned adjacent the opening 22 and may be grasped to easily extract the string 12 from the housing 16.

Figure 1B:
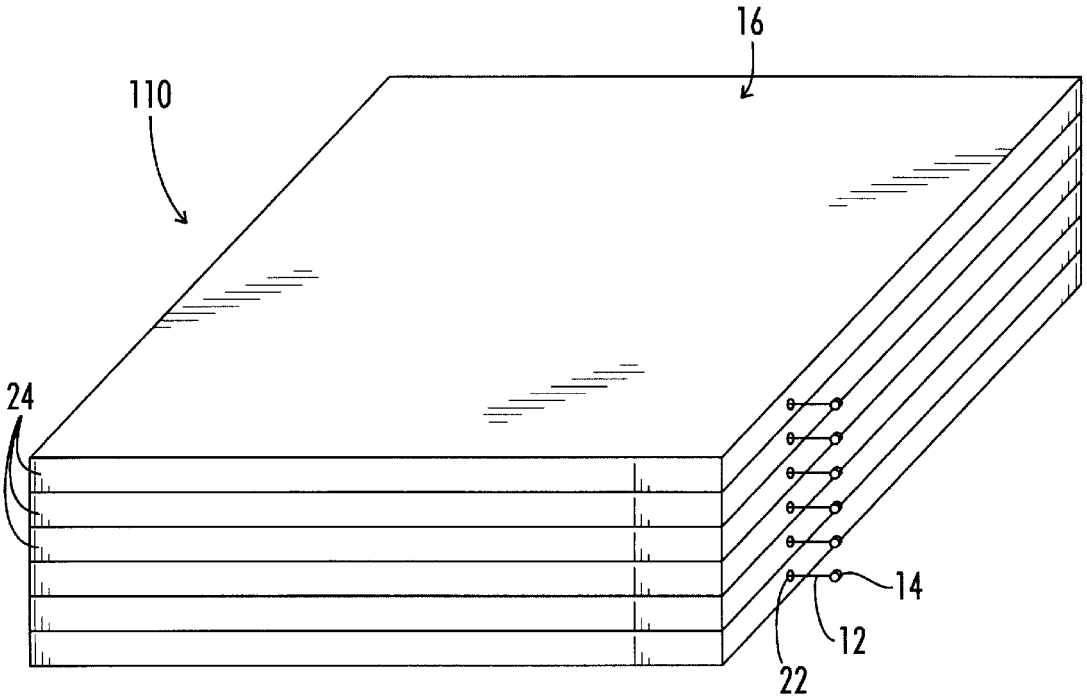
FIG. 1B is a perspective view of an embodiment of a multiple string package and dispenser of the present invention.

With reference to FIG. 1B, an alternate embodiment of a multiple string package of the present invention is designated generally by reference numeral 110. The package 110 includes a plurality of separate compartments 24 in a stacked configuration. Each compartment 24 comprises a housing 16 for containing a string 12 in a generally coiled position. An opening or aperture 22 is formed in the peripheral edge 18 of each compartment 24 to enable a string 12 to be extracted from the housing 16 by grasping the protruding end.

Figure 2A:
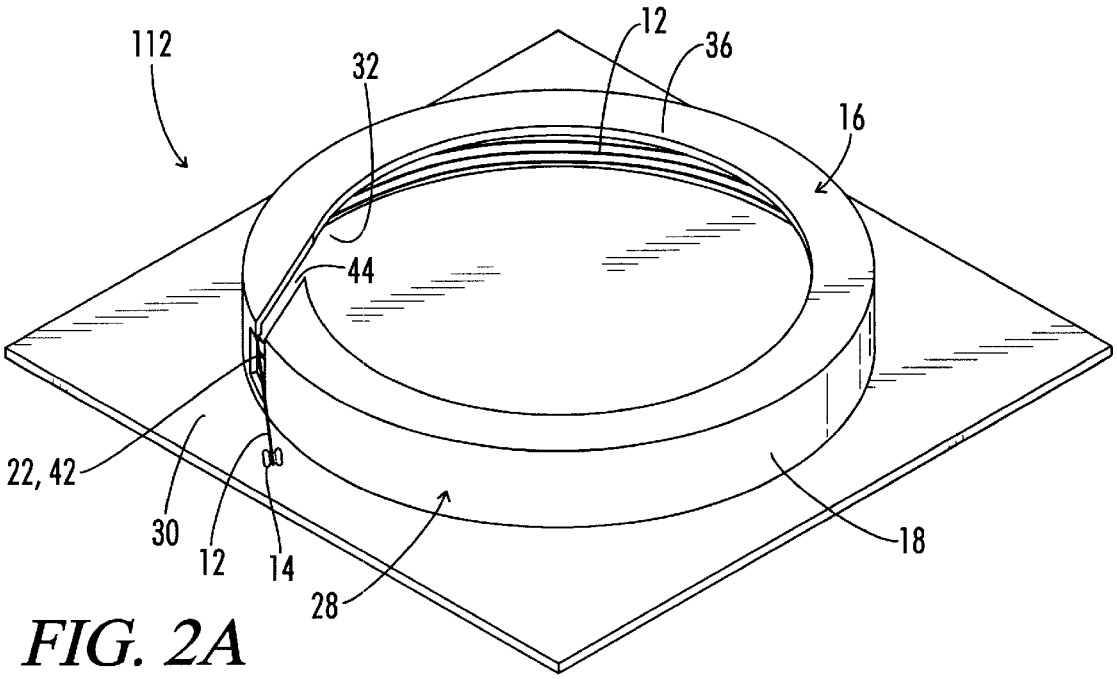
FIG. 2A is a perspective view of an alternate embodiment of a single string package and dispenser of the present invention.
Figure 2B:
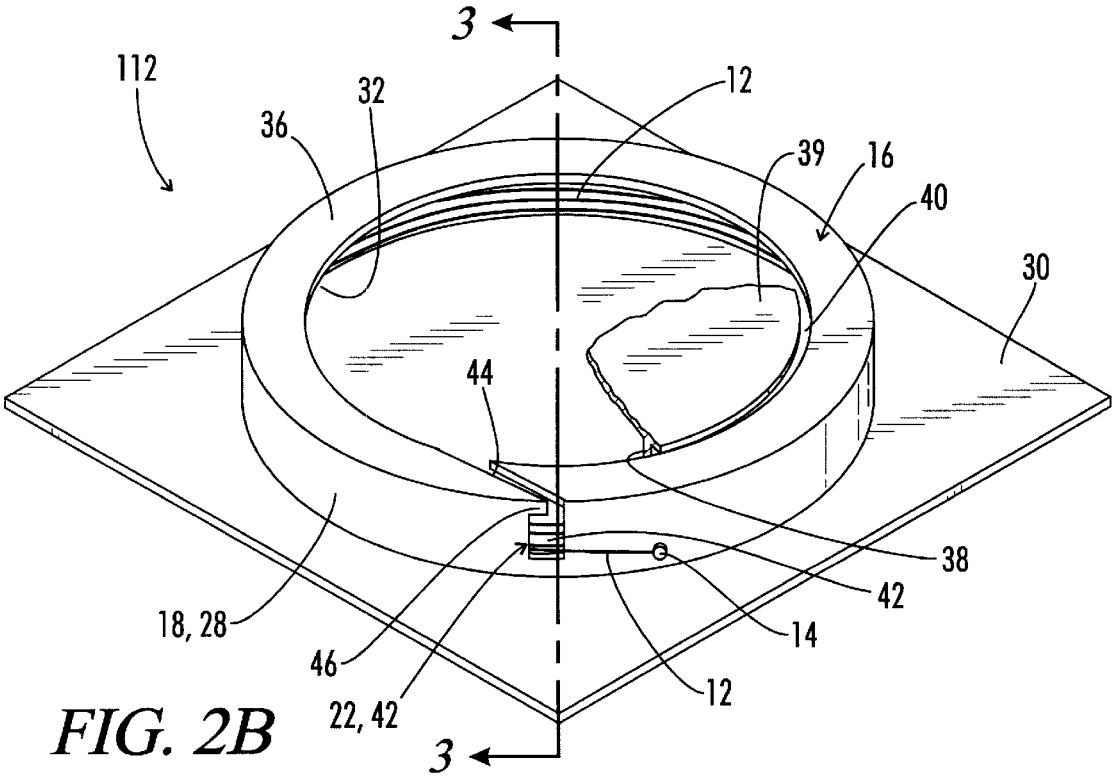
FIG. 2B is a rotated perspective view of the embodiment of the present invention shown in FIG. 2A.

With reference to FIGS. 2A and 2B, a single string package of the present invention is designated generally by reference numeral 112. In this embodiment, the package 112 includes a housing 16 comprising an annular retaining ring 28 mounted on a bottom or base 30. The retaining ring 28 may also be described as a peripheral edge 18 or as an outer wall. The retaining ring 28 forms an annular cavity 32 adapted to receive and contain a coiled string 12. The cavity 32 is defined by the base or bottom 30, the ring 28, and a rim or lip 36 projecting inwardly from the upper portion of the periphery 18 to form a top. Thus, the ring 28 prevents lateral expansion of the string 12, and the base 30 and rim 36 provide vertical containment to restrain the coiled portion of the string in a direction of a central axis of the coiled portion. The central portion of the top 36 may be open as shown in FIG. 2A for facilitating insertion of a string 12 into the retaining ring 28.

Figure 3:
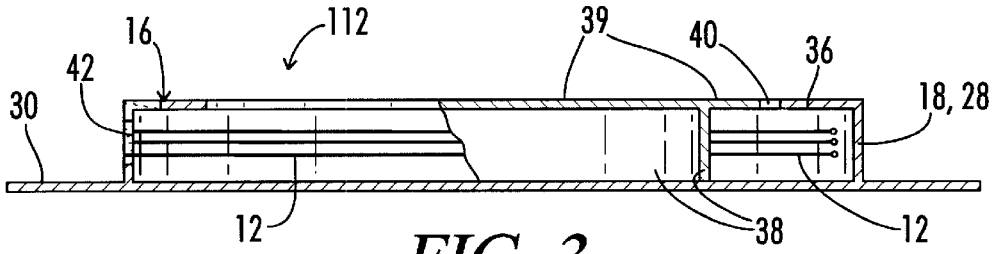
FIG. 3 is a side sectional view of the embodiment of the present invention shown in FIG. 2B taken along line 3—3.

In an alternate embodiment seen in FIGS. 2B and 3, the retaining ring 28 may further include an inner wall or core or spool 38 spaced from, and substantially parallel to, the ring 28. The inner wall 38 preferably supports a cap 39 so that an annular opening 40 is provided between the cap 39 and the rim 36 to enable a string 12 to be inserted into the annular cavity 32. Further, the inner wall 38 forms a spool or core about which the string 12 may be coiled to prevent tangling as described hereinabove. Accordingly, the string 12 may be wound about the spool 38 to prevent the coiled portion of the string 12 from collapsing inward and becoming tangled, particularly when the string 12 is being extracted from the housing 16.

Figure 4:
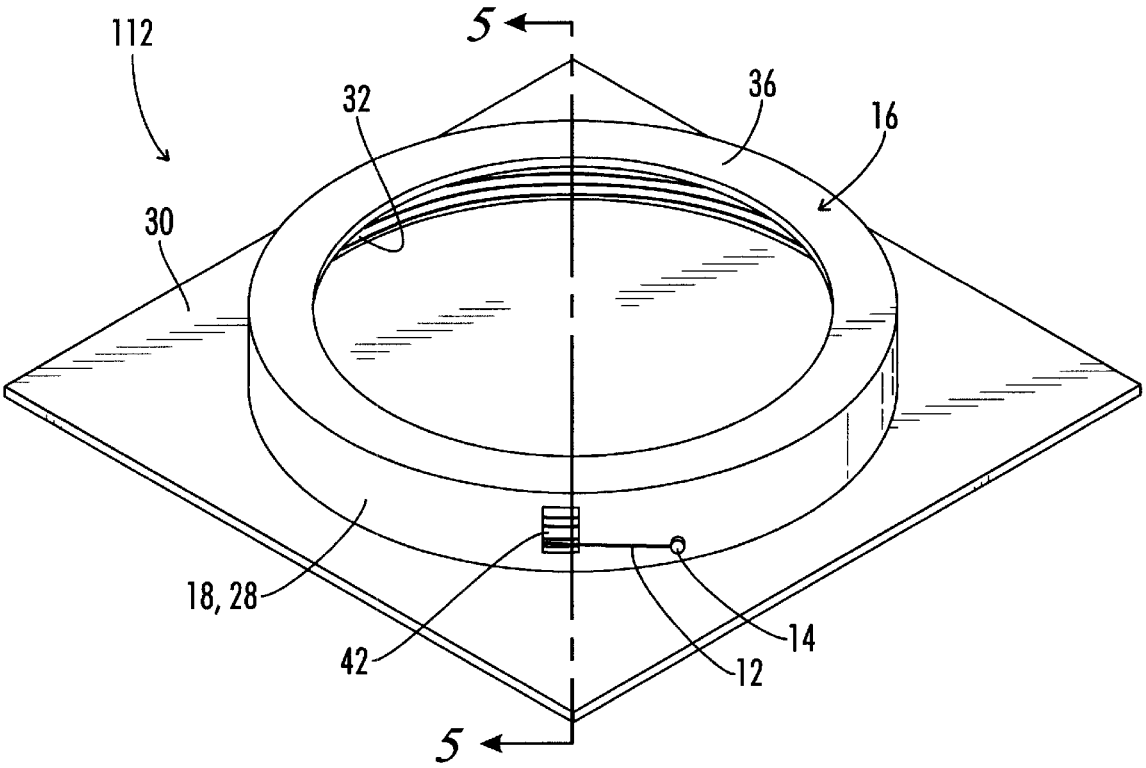
FIG. 4 is a perspective view of the single string package and dispenser of FIG. 2A showing an alternate embodiment of the opening.
Figure 5:
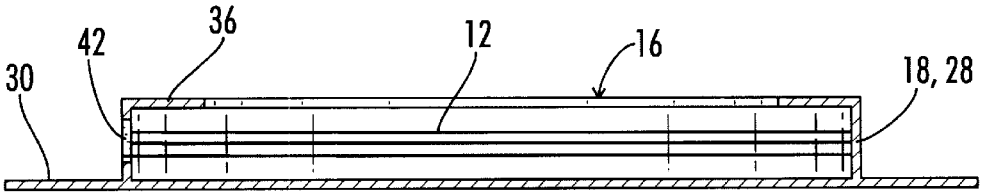
FIG. 5 is a side sectional view of the embodiment of the string package and dispenser shown in FIG. 4 taken along line 5—5.
Figure 6:
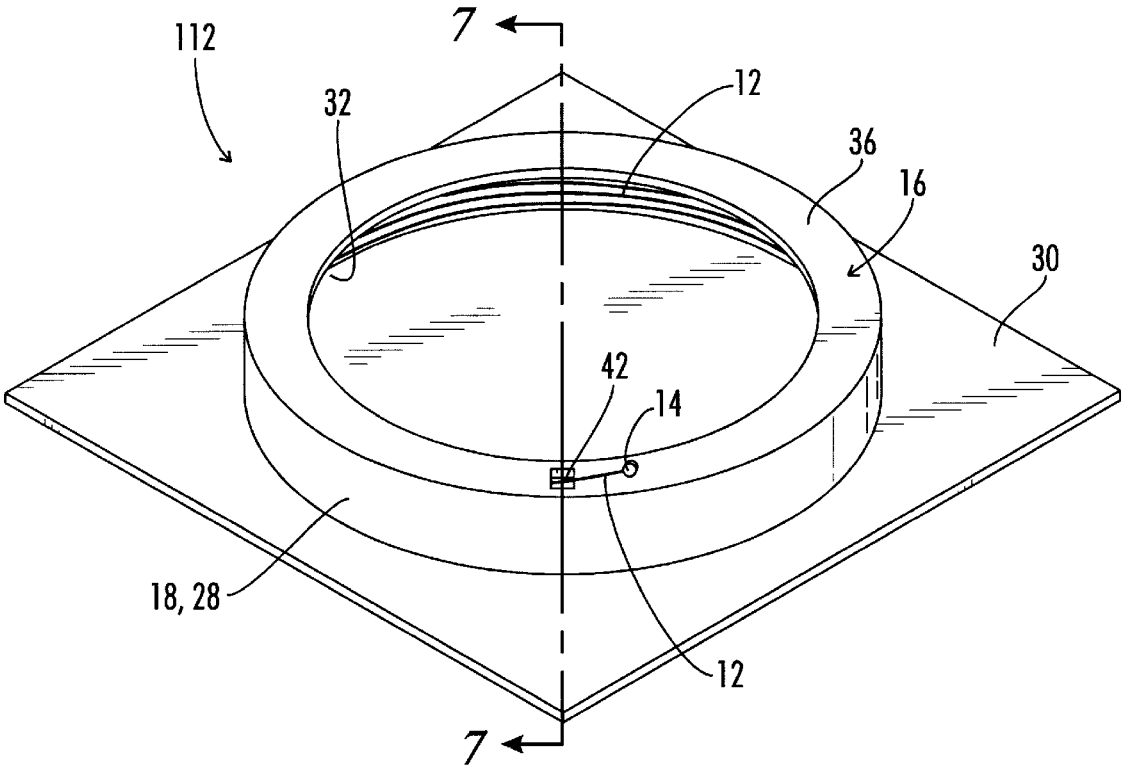
FIG. 6 is a perspective view of the single string package and dispenser of FIG. 2A showing an alternate embodiment of the opening.
Figure 7:
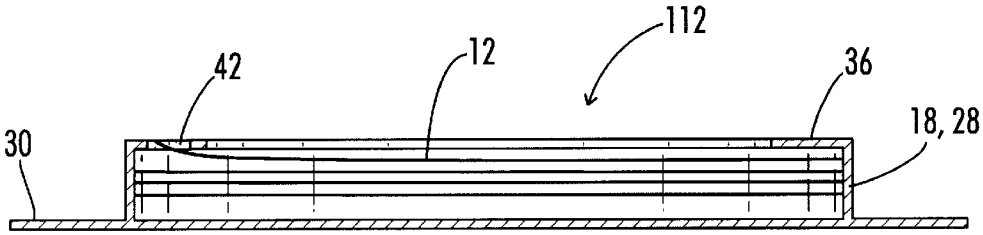
FIG. 7 is a side sectional view of the embodiment of the string package and dispenser shown in FIG. 6 taken along line 7—7.

The package 112 includes an opening or aperture 22 from which an end of the string 12 protrudes to facilitate extraction of the string 12 from the cavity 32. With reference to FIGS. 2A and 2B, the opening 22 may comprise an aperture 42 formed in the outer wall 34 and a slot 44 formed in the rim 36. The aperture 42 intersects with the slot 44 to form a continuous opening 22. A hook or tab 46 projecting into the opening 22 may be formed at the intersection of the aperture 42 and the slot 44. Thus, when the string 12 is inserted into the cavity 32 such that the connector 14 protrudes from the opening 22, the tab 46 serves to anchor the connector 14 and prevent it from retracting into the cavity 32. Alternatively, the opening 22 may comprise an aperture 42 formed in either the outer wall 34 (see FIG. 4) or the rim 36 (see FIG. 6).

Figure 8:
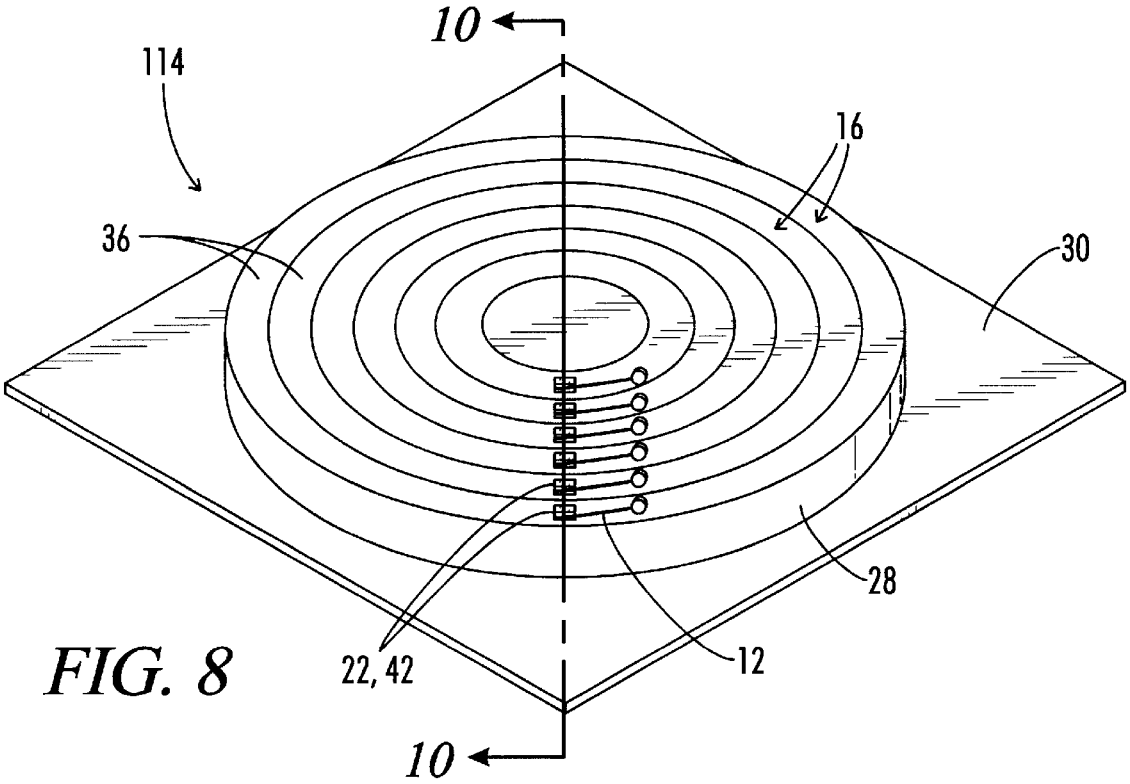
FIG. 8 is a perspective view of an alternate embodiment of the multiple string package and dispenser of the present invention.
Figure 9:
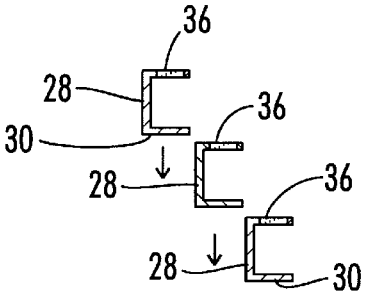
FIG. 9 is a partial side sectional view of the embodiment of the string package and dispenser shown in FIG. 8 illustrating the manner in which individual string compartments may be assembled after a string is inserted therein.
Figure 10:
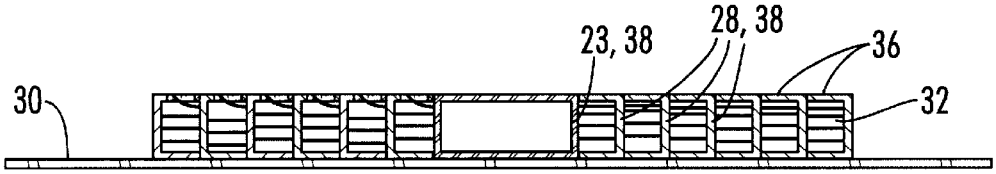
FIG. 10 is a side sectional view of the embodiment of the string package and dispenser shown in FIG. 8 taken along line 10—10.
Figure 13:
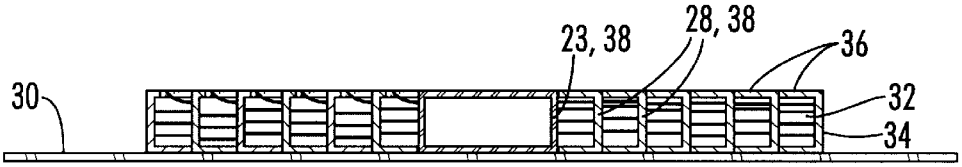
FIG. 13 is a side sectional view of the embodiment of the string package and dispenser shown in FIG. 11 taken along line 13—13.

With reference to FIG. 8, an alternate embodiment of the present invention comprises a multiple string package designated generally by the reference numeral 114. The multiple string package 114 preferably comprises a plurality of housings 16 defined by concentric retaining rings 28 mounted on a base 30. As set forth hereinabove, each of the housings 16 includes an annular cavity 32 defined by a ring 28 and a rim or lip 36 projecting inwardly from an upper portion of the ring 28. With the exception of the innermost retaining ring 28, each successive retaining ring 28 forms the inner wall or spool 38 of the next adjacent retaining ring 28 when the retaining rings 28 are nested as shown in FIGS. 8 and 13.

A central spool or core 23 may be disposed within the center of the assembly such that the outer peripheral surface of the cylinder 23 forms the inner wall 38 of the innermost retaining ring 28.

Similar to the embodiments described hereinabove, openings 22 are formed in each of the housings 16 to facilitate the extraction of a string 12 therefrom. The opening 22 may comprise an aperture 42 formed in the ring 28, the rim 36, or the base 30, depending on the relative position of the housing 16. Thus, the opening 22 in the outermost housing 16 may be formed in either the ring 28, the rim 36 or the base 30, whereas the opening 22 in the interior housings 16 may be formed in either the rim 36 or the base 30, as the ring 28 of the interior housings 16 form the interior partition walls between adjacent housings 16. Alternatively, the opening 22 comprises a notch 48 formed along an inner periphery of the rim 36 (see FIG. 11).

Figure 11:
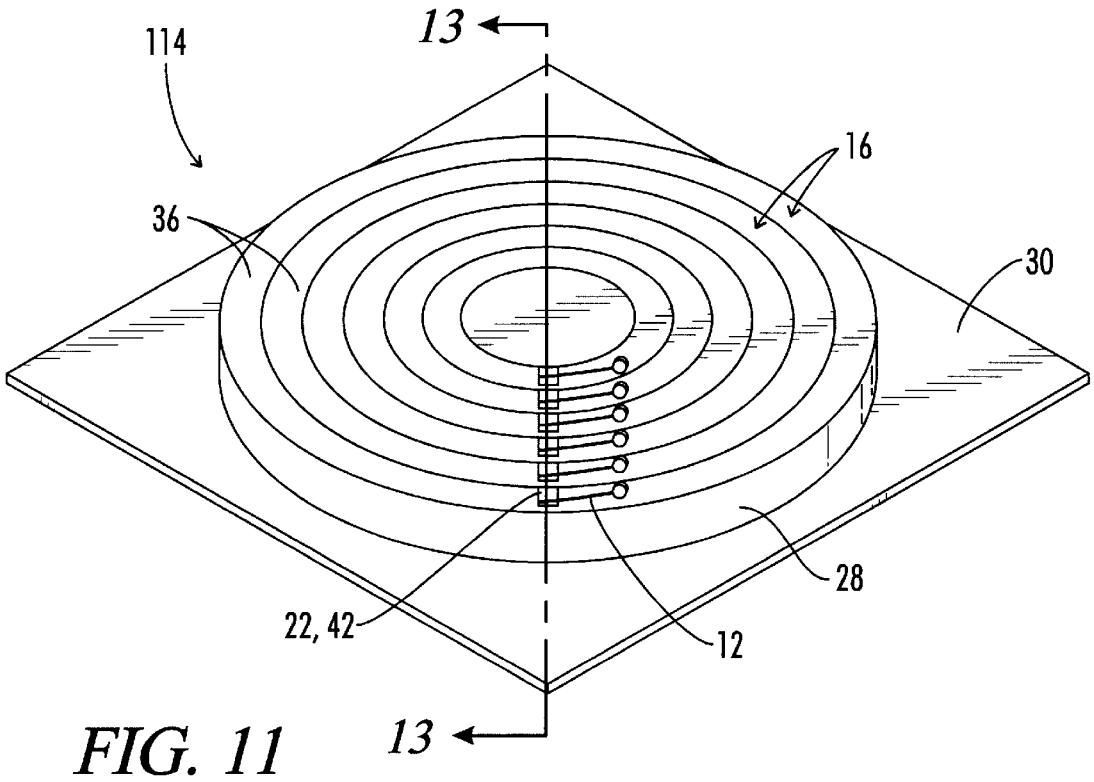
FIG. 11 is a perspective view of an alternate embodiment of the multiple string package and dispenser of FIG. 8.
Figure 12:
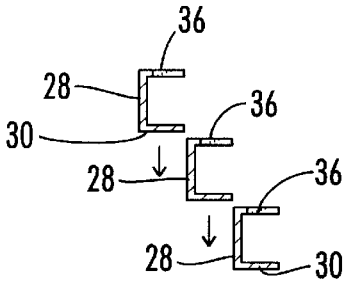
FIG. 12 is a partial side sectional view of the embodiment of the string package and dispenser shown in FIG. 11 illustrating the manner in which individual string compartments may be assembled after a string is inserted therein.

Further, although not shown in FIG. 11, each of the concentric housings 16 may include an annular opening 40 (similar to opening 40 shown in FIG. 2B) between the rim 36 and the ring 28 to facilitate insertion of the string 12 into the package.

Figure 16:
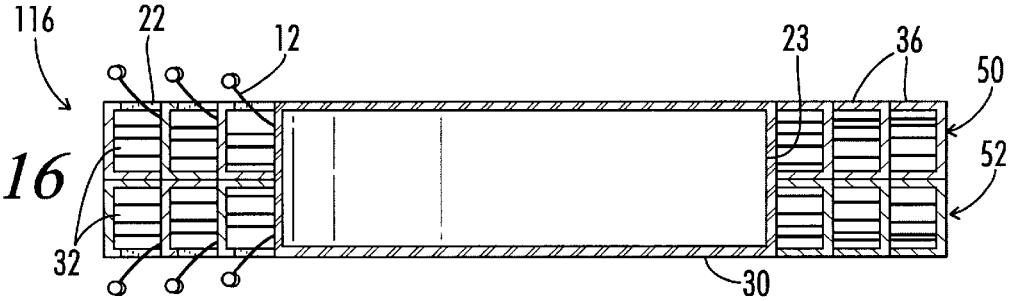
FIG. 16 is a side sectional view of an alternate embodiment of the multiple string package and dispenser of the present invention.
Figure 17:
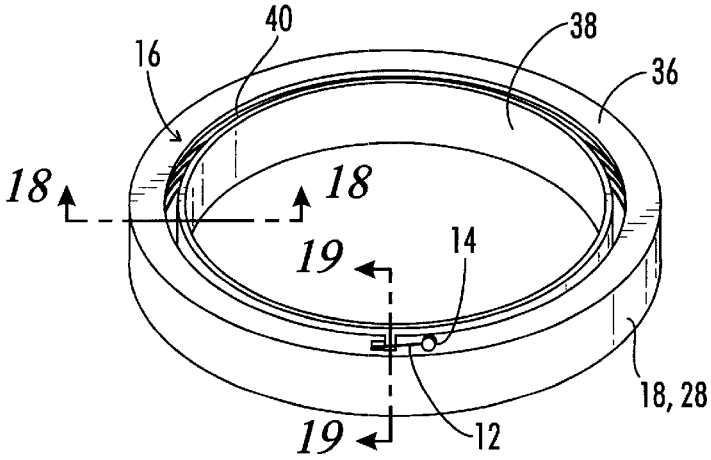
FIG. 17 is a perspective view of an alternate embodiment of the single string package and dispenser of the present invention.
Figure 18:
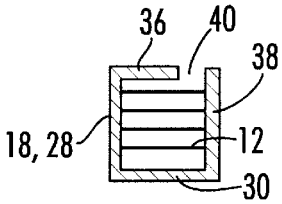
FIG. 18 is a side sectional view of the embodiment of the string package and dispenser shown in FIG. 17 taken along lines 18—18.
Figure 19:
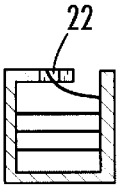
FIG. 19 is a side sectional view of the embodiment of the string package and dispenser shown in FIG. 17 taken along lines 19—19.

Yet another embodiment of the string package of the present invention is designated generally by the reference numeral 116 in FIG. 16. The package 116 includes first 50 and second 52 sets of retaining rings in a stacked configuration to form a single unit. Each of the first 50 and second 52 sets of retaining rings comprises a plurality of individual housings 16 for housing and dispensing a string 12. Each of the individual housings 16 is configured generally as set forth hereinabove; thus, each housing 16 includes an opening 22 into the annular cavity 32 to enable insertion and extraction of a string 12. The openings 22 into each of the housings 16 of the first set 50 (the upper set) are preferably formed in the top surface 36 of the unit, whereas the openings 22 into each of the housings 16 of the second set 52 (the lower set) are preferably formed in the base 30 of the unit.

Figure 14:
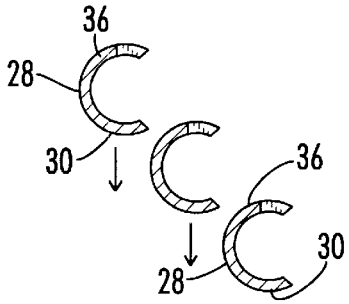
FIG. 14 is a partial side sectional view of an alternate embodiment of the multiple string package and dispenser of the present invention illustrating the manner in which individual string compartments may be assembled after a string is inserted therein.
Figure 15:
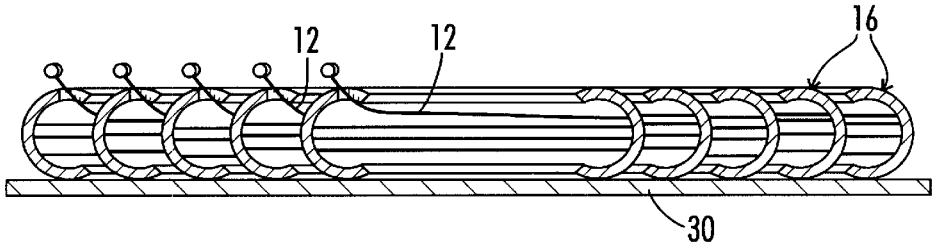
FIG. 15 is a side sectional view of an alternate embodiment of the multiple string package and dispenser of the present invention.

The configuration of the housings 16 may be planar, such that the ring or outer ring or wall 28, the rim 36 and the base 30 are discrete (see FIGS. 9, 12, 18 and 19). Alternatively, the configuration of the housings 16 may be arcuate such that the ring or outer wall 28, the rim 36 and the base 30 merge to form a continuous wall. as desired (see FIGS. 14 and 15). Furthermore, the base 30 may be formed integrally with the housings 16 or may comprise a separate mounting board.

The present invention also includes a method for dispensing at least one musical instrument string comprising the steps of providing a package having a coiled portion of the musical instrument string disposed therein with a free end of the musical instrument string protruding from an opening in the package; laterally restraining the coiled portion of the musical instrument string within the package to retain the coiled portion in a coiled configuration until the coiled portion is dispensed from the package; grasping the free end; pulling the string by the free end through the opening; and uncoiling the coiled portion of the string by rotating the coiled portion of the string as the free end of the string is pulled through the opening. The free end of the string may include a connector attached thereto, in which case the step of grasping the free end further includes grasping the connector. The method further comprises the step of preventing the connector from passing back through the opening into the package.

The method also contemplates providing a plurality of coiled musical instrument strings disposed in the package, each of the strings having a free end extending through a respective one of a plurality of openings in the package, and individually pulling each of the strings from the package by grasping its respective free end and pulling each string through its respective opening thereby uncoiling each string as it is pulled from the package.

Thus, although there have been described particular embodiments of the present invention of a new and useful package for musical instrument strings, it is not intended that such references be construed as limitations upon the scope of this invention except as set forth in the following claims. Further, any dimensions used in the preferred embodiment are not intended to be construed as limitations upon the scope of this invention except as set forth in the following claims.

What we claim is:

1. A method for dispensing a musical instrument string, the method comprising the steps of:

(a) providing a package having a coiled portion of the musical instrument string disposed therein with a free end of the musical instrument string protruding from an opening in the package;

(b) laterally restraining the coiled portion of the musical instrument string within the package to retain the coiled portion in a coiled configuration until the coiled portion is dispensed from the package;

(c) grasping the free end;

(d) pulling the string by the free end through the opening; and (e) uncoiling the coiled portion of the string by rotating the coiled portion of the string as the free end of the string is pulled through the opening.

2. The method of claim 1, the free end of the string having a connector attached thereto, wherein:

step (c) includes grasping the connector.

3. The method of claim 1, the free end of the string having a connector attached thereto, further comprising the step of:

preventing the connector from passing back through the opening into the package.

4. The method of claim 1, wherein:

step (a) includes providing a plurality of such coiled musical instrument strings disposed in the package, each of the strings having a free end extending through a respective one of a plurality of such openings in the package; and further comprising individually pulling each of the strings from the package by grasping its respective free end and pulling each string through its respective opening thereby uncoiling each string as it is pulled from the package.

5. The method of claim 1, wherein:

step (a) is further characterized in that the package includes a cylindrical core about which the coiled portion of the string is received; and further including during step (e), the presence of the core preventing the coiled portion of the string from collapsing inward as the coiled portion is uncoiled.

6. The method of claim 1, further comprising:

axially restraining the coiled portion of the musical instrument string within the package.

7. A method of packaging a set of strings for a stringed musical instrument, the strings being constructed of a relatively resilient material such that the strings will rapidly spring to an uncoiled position if not confined in a coiled configuration, the method comprising the steps of:

(a) providing a self dispensing package having a freely rotatable coiled portion of each musical instrument string disposed therein with a free end of each musical instrument string protruding from an opening in the package;

(b) laterally restraining the coiled portions of the musical instrument strings within the package to retain the coiled portions in coiled configurations until each coiled portion is dispensed from the package;

(c) preventing the free ends of the strings from passing back through the opening into the package.

8. The method of claim 7, wherein:

step (b) includes restraining the coiled portions around a periphery of the coil and in opposite planes parallel to said coil.

9. The method of claim 7, wherein:

step (a) is further characterized in that the package includes a plurality of cylindrical cores, the coiled portion of each string being received about one of the cores; and further including individually pulling each string by its free end and uncoiling the coiled portion of the string by rotating the coiled portion of the string about its respective core; and thereby preventing the coiled portion of each string from collapsing inward as the coiled portion is uncoiled.

10. A self dispensing musical instrument string package apparatus, comprising:

a housing having at least one chamber defined therein and having at least one opening formed in the housing and communicated with the chamber;

at least one musical instrument string having a freely rotatable coiled portion disposed in the chamber and having a free end extending from the chamber out through the opening, the string being constructed of a relatively resilient material such that the string will spring to an uncoiled position if not confined in a coiled position;

wherein the at least one chamber further comprises a plurality of chambers defined within the housing; and wherein the at least one musical string further comprises a plurality of strings, one string being disposed in each of the chambers.

11. The apparatus of claim 10, wherein:

each of the free ends include s a connector thereon.

12. The apparatus of claim 11, wherein:

the connectors are larger than the openings thereby preventing passage of the connectors through the openings.

13. The apparatus of claim 10, wherein:

the plurality of chambers are positioned in parallel planes.

14. The apparatus of claim 10, wherein:

the plurality of chambers are concentric.

15. The apparatus of claim 10, wherein the plurality of chambers further comprise:

first and second sets of concentric chambers positioned in parallel planes.

16. The apparatus of claim 10, further comprising:

means for holding the free end of the string outside of the opening.

17. The apparatus of claim 10, wherein the housing further comprises a cylindrical core about which the coiled portion of the string is received, the core defining a radially inner wall of the chamber.

18. The apparatus of claim 10, wherein the housing further comprises a cylindrical outer wall which laterally restrains the coiled portion of the string.

19. The apparatus of claim 10, wherein the housing further comprises:

first and second radially extending planar walls which restrain the coiled portion of the string in a direction of a central axis of the coiled portion.

20. A self dispensing musical instrument string package apparatus, comprising:

a housing having at least one chamber defined therein and having at least one opening formed in the housing and communicated with the chamber; and at least one musical instrument string having a freely rotatable coiled portion disposed in the chamber and having a free end extending from the chamber out through the opening, the free end including a connector thereon, the string being constructed of a relatively resilient material such that the string will spring to an uncoiled position if not confined in a coiled position.

21. The apparatus of claim 20, wherein the housing further comprises a cylindrical core about which the coiled portion of the string is received, the core defining a radially inner wall of the chamber.

22. The apparatus of claim 20, wherein the housing further comprises a cylindrical outer wall which laterally restrains the coiled portion of the string.

23. The apparatus of claim 20, wherein the housing further comprises:

first and second radially extending planar walls which restrain the coiled portion of the string in a direction of a central axis of the coiled portion.

24. A self dispensing musical instrument string package apparatus, comprising:

a housing having at least one chamber defined therein and having at least one opening formed in the housing and communicated with the chamber;

at least one musical instrument string having a freely rotatable coiled portion disposed in the chamber and having a free end extending from the chamber out through the opening, the string being constructed of a relatively resilient material such that the string will spring to an uncoiled position if not confined in a coiled position; and means for holding the free end of the string outside of the opening.

* * * * *